US005965468A

United States Patent [19]

Marmon et al.

[11] Patent Number: 5,965,468

[45] Date of Patent: Oct. 12, 1999

[54] DIRECT FORMED, MIXED FIBER SIZE NONWOVEN FABRICS

[75] Inventors: Samuel Edward Marmon, Alpharetta; Christopher Cosgrove Creagan, Marietta, both of Ga.

[73] Assignee: Kimberly-Clark Worldwide, Inc., Neenah, Wis.

[21] Appl. No.: 08/962,508

[22] Filed: Oct. 31, 1997

[51] Int. Cl.[6] ..... D06G 3/00

[52] U.S. Cl. ..... 442/340; 442/347

[58] Field of Search ..... 442/340, 347

[56] References Cited

U.S. PATENT DOCUMENTS

| | | | |
|---|---|---|---|
| 3,338,992 | 8/1967 | Kinney | 264/24 |
| 3,341,394 | 9/1967 | Kinney | 161/72 |
| 3,502,763 | 3/1970 | Hartmann | 264/210 |
| 3,542,615 | 11/1970 | Dobo et al. | 156/181 |
| 3,692,618 | 9/1972 | Dorschner et al. | 161/72 |
| 3,802,817 | 4/1974 | Matsuki et al. | 425/66 |
| 4,340,563 | 7/1982 | Appel et al. | 264/518 |
| 4,636,209 | 1/1987 | Lassen | 604/378 |
| 4,762,520 | 8/1988 | Wallstrom | 604/366 |
| 4,795,668 | 1/1989 | Krueger et al. | 428/174 |
| 4,834,735 | 5/1989 | Alemany et al. | 604/368 |
| 4,988,344 | 1/1991 | Reising et al. | 604/368 |
| 5,037,409 | 8/1991 | Chen et al. | 604/358 |
| 5,047,023 | 9/1991 | Berg | 604/368 |
| 5,057,368 | 10/1991 | Largman et al. | 428/397 |
| 5,069,970 | 12/1991 | Largman et al. | 428/373 |
| 5,108,820 | 4/1992 | Kaneko et al. | 428/198 |
| 5,188,892 | 2/1993 | Grindstaft | 428/362 |
| 5,277,976 | 1/1994 | Hogle et al. | 428/397 |
| 5,281,207 | 1/1994 | Chmielewski et al. | 604/378 |
| 5,330,457 | 7/1994 | Cohen | 604/378 |
| 5,336,552 | 8/1994 | Strack et al. | 428/224 |
| 5,348,547 | 9/1994 | Payne et al. | 604/378 |
| 5,364,382 | 11/1994 | Latimer et al. | 604/378 |
| 5,382,400 | 1/1995 | Pike et al. | 264/168 |
| 5,413,857 | 5/1995 | Hagen et al. | 428/362 |
| 5,429,629 | 7/1995 | Latimer et al. | 604/378 |
| 5,456,971 | 10/1995 | Fahmy | 428/212 |
| 5,466,410 | 11/1995 | Hills | 264/172.11 |
| 5,466,513 | 11/1995 | Wanek et al. | 428/218 |
| 5,540,992 | 7/1996 | Marcher et al. | 428/373 |
| 5,679,042 | 10/1997 | Varona | 442/347 |

FOREIGN PATENT DOCUMENTS

| | | | |
|---|---|---|---|
| 25 13 251 | 9/1976 | Germany | D01F 8/08 |
| 95 35081 | 12/1995 | WIPO | A61F 13/15 |
| 96 41045 | 12/1996 | WIPO | D04H 1/46 |
| 97 11660 | 4/1997 | WIPO | A61F 13/15 |

*Primary Examiner*—Newton Edwards
*Attorney, Agent, or Firm*—James B. Robinson

[57] ABSTRACT

There is disclosed an nonwoven fabric suitable for use as, for example, an intake/distribution material for personal care products, made from nonwoven fabric where the fabric is made from directly formed, mixed size fibers. The fibers may be conjugate fibers. The fabric may have zones having larger fibers and zones having smaller fibers providing a means to vary the web properties, such as permeability, or the mixed size fibers may be uniformly distributed. The fibers may also be crimped. The process for making such a material is also disclosed.

A zoned fiber fabric can provide rapid intake of an insult because of the placement of the high permeability zone in the insult target area and can also provide good distribution through the lower permeability but higher capillarity end zones.

21 Claims, 5 Drawing Sheets

DIRECT FORMED, MIXED FIBER SIZE NONWOVEN FABRICS

FIELD OF THE INVENTION

The present invention is directed to fibrous nonwoven webs. More particularly, the present invention relates to direct-formed (polymer to fabric) fibrous nonwoven webs suitable for use in liquid absorbent applications like personal care products.

BACKGROUND OF THE INVENTION

Current personal care products are generally inefficient in that the products will leak when only a relatively small fraction of the available absorbent capacity of the product is used. This can be the result of a product design that does not obtain the maximum performance of the absorbent system, but is often caused by the inefficiency of the absorbent system itself. To be highly efficient, absorbent systems must:

accept the liquid at the rate it is delivered each time the product is insulted (Intake), distribute the liquid throughout the product (Distribution), and, store the liquid (Retention).

Highly efficient systems are desirable because they allow the products to be made from less material thus providing thinner, more discrete, better fitting products and a reduction in the amount of material that must be disposed of. It is also desirable to have a single material accomplish all three functions to provide manufacturing simplicity and thus low manufacturing cost.

Often, distinct materials are required to accomplish each function since the material properties favoring one function are frequently contrary to those needed for another. For example, fibrous materials that provide good liquid intake typically have relatively large distances between fibers to provide space for the entering liquid to permeate, and minimal resistance to drainage of the fluid into the distribution and retention components. That is, they have relatively high permeability and provide relatively low capillary tension. However, distribution materials that rely on capillary tension as the driving force for wicking require relatively small distances between fibers, especially when liquid is to be moved vertically such as in a diaper worn on a child in the standing position. That is, distribution materials generally have relatively low permeability and provide relatively high capillary tension. Examples of good intake materials include those described as surge management materials in U.S. Pat. No. 5,364,382 (Latimer et al.) which are suitable for providing good liquid intake, but require some other material in liquid communication with them to deliver the needed distribution and retention. Similarly, examples of distribution materials and retention materials that benefit from other materials to provide the other functions may be found in U.S. patent application Ser. No. 08/754,414.

It is an objective of this invention to provide flexibility in the production of nonwoven webs so that they may be tailored to the required properties of the product into which they are manufactured. For example, liquid intake and distribution functions in one material may be so produced. In one embodiment this invention may be used to provide a material having relatively distinct areas of permeability in the X-Y plane. In another embodiment, this invention may be used to provide very uniform low density fabrics.

SUMMARY OF THE INVENTION

The objects of the invention are provided by novel spin pack designs which bring mixed polymer metering rates and, optionally, mixed polymer ratios together in the same polymer distribution system.

The invention may be used to produce an intake/distribution material for personal care products made from a nonwoven fabric where the fabric has a central zone and two end zones, in which the central zone has higher permeability than the end zones. The invention may also be used to produce a highly uniform, low density fabric having fibers of different sizes.

One embodiment allows the material to rapidly intake an insult because of the placement of a highly permeable zone in the insult target area and also provides good distribution through the lower permeability but higher capillarity end zones.

In this embodiment, a first zone preferably has a permeability at least about 2 times that of a second zone and the material is preferably a crimped fiber side-by-side conjugate fiber nonwoven web produced by the spunbond process and having fibers of a different size in each of the zones. The first zone should have fibers of larger diameter than the second zone in order to produce higher permeability and should have polymer ratios of about 40:60 in order to maximize fiber crimp.

In another embodiment, fibers having two or more different sizes are intermixed very thoroughly as produced, resulting in a highly uniform fabric.

DEFINITIONS

Figure 1:
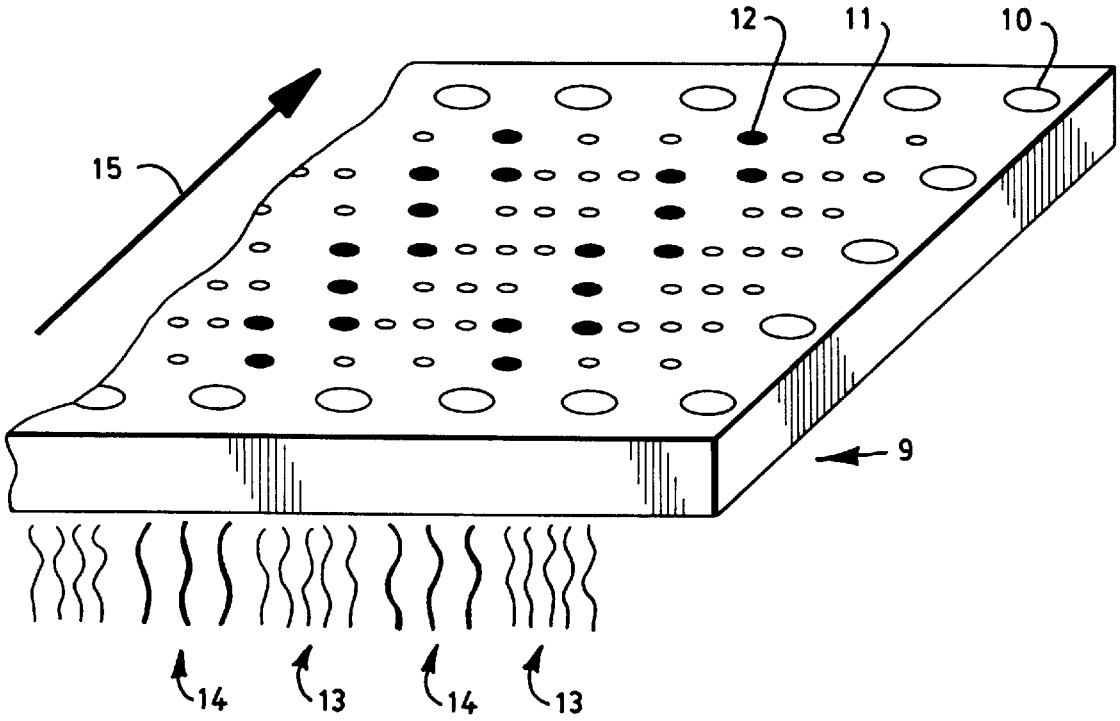
FIG. 1 is a diagram of a spin plate in which the holes through which high polymer throughputs are desired are larger than the holes where the lower throughputs are desired.

As used herein the term "nonwoven fabric or web" means a web having a structure of individual fibers or threads which are interlaid, but not in an identifiable manner as in a knitted fabric. Nonwoven fabrics or webs have been formed from many processes such as for example, meltblowing processes, spunbonding processes, and bonded carded web processes. The basis weight of nonwoven fabrics is usually expressed in ounces of material per square yard (osy) or grams per square meter (gsm) and the fiber diameters are usually expressed in microns. (Note that to convert from osy to gsm, multiply osy by 33.91).

A frequently used expression of fiber linear density is denier, which is defined as grams per 9000 meters of a fiber and may be calculated, for fibers having a round cross-section, as fiber diameter in microns squared, multiplied by the density in grams/cc, multiplied by 0.00707. A lower linear density indicates a finer fiber and a higher linear density indicates a thicker or heavier fiber. For example, the diameter of a polypropylene fiber given as 15 microns may be converted to denier by squaring, multiplying the result by 0.89 g/cc and multiplying by 0.00707. Thus, a 15 micron polypropylene fiber has a denier of about 1.42 ($15^2 \times 0.89 \times 0.00707 = 1.415$). Outside the United States the unit of measurement is more commonly the "tex", which is defined as the grams per kilometer of fiber. Tex may be calculated as denier/9.

As used herein the term "spunbonded fibers" refers to small diameter fibers which are formed by extruding molten thermoplastic material as filaments from a plurality of fine, usually circular capillaries of a spinneret with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, and U.S. Pat. No. 3,542,615 to Dobo et al. Spunbond fibers are generally not tacky when they are deposited onto a collecting surface. Spunbond fibers are generally continuous and have average diameters (from a sample of at least 10) larger than 7 microns, more particularly, between about 10 and 30 microns. The fibers may also have shapes such as those described in U.S. Pat. No. 5,277,976 to Hogle et al., U.S. Pat. No. 5,466,410 to Hills and U.S. Pat. Nos. 5,069,970 and 5,057,368 to Largman et al., which describe fibers with unconventional shapes.

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

As used herein, the term "direct formed" means a fabric formed directly from fibers as they are spun as contrasted with fabric formed from fibers collected upon spinning and reprocessed into fabric at a later time.

As used herein, the term "spin pack" means a device for accepting molten polymer, distributing and metering the polymer, and forming fibers from the polymer. A spin pack generally includes four parts; (1) a "top block" to accept the polymer from a source and distribute it across the entire pack cross directional width, (2) a "screen support plate" which holds and provides support for the pack's polymer filters or screens, and which distributes the polymer evenly in the machine direction, (3) "distribution plates", sometimes called metering plates, of which there may be more than one, which are responsible for distributing the polymer to the holes of the final component the (4) spin plate which actually forms the fibers and is usually the most expensive and delicate component of the spin pack.

As used herein, the term "machine direction" or MD means the length of a fabric in the direction in which it is produced. The term "cross machine direction" or CD means the width of fabric, i.e. a direction generally perpendicular to the MD.

As used herein the term "conjugate fibers" refers to fibers which have been formed from at least two polymers extruded from separate extruders but spun together such that each of the resulting fibers contains both polymers. Conjugate fibers are also sometimes referred to as multicomponent or bicomponent fibers. The polymers are usually different from each other though conjugate fibers may be monocomponent fibers. The polymers are arranged in substantially constantly positioned distinct zones across the cross-section of the conjugate fibers and extend continuously along the length of the conjugate fibers. The configuration of such a conjugate fiber may be, for example, a sheath/core arrangement wherein one polymer is surrounded by another or may be a side by side arrangement, a pie arrangement or an "islands-in-the-sea" arrangement. Conjugate fibers are taught in U.S. Pat. No. 5,108,820 to Kaneko et al., U.S. Pat. No. 4,795,668 to Krueger et al., U.S. Pat. No. 5,540,992 to Marcher et al. and U.S. Pat. No. 5,336,552 to Strack et al. Conjugate fibers are also taught in U.S. Pat. No. 5,382,400 to Pike et al. and may be crimped by using the differential rates of expansion and contraction of the two (or more) polymers. Crimped fibers may also be produced by mechanical means and by the process of German Patent DT 25 13 251 A1. For two component fibers, the polymers may be present in ratios of 75/25, 50/50, 25/75 or any other desired ratios. The fibers may also have shapes such as those described in U.S. Pat. No. 5,277,976 to Hogle et al., U.S. Pat. No. 5,466,410 to Hills and U.S. Pat. Nos. 5,069,970 and 5,057,368 to Largman et al., which describe fibers with unconventional shapes. These shapes may be multilobal, star shaped, or shaped like the letters C, E, X, T, etc.

As used herein, through-air bonding or "TAB" means a process of bonding a nonwoven web in which air, sufficiently hot to melt one of the polymers of the fibers of the web, is forced through the web. The air velocity is between 100 and 500 feet per minute and the dwell time may be as long as 6 seconds. The melting and resolidification of the polymer provides the bonding. Through-air bonding has relatively restricted variability and since through-air bonding (TAB) requires the melting of at least one component to accomplish bonding, it is preferably applied to webs with two components like conjugate fibers or those which include an adhesive. In bonding conjugate fiber webs in a through-air bonder, air having a temperature above the melting temperature of one component and below the melting temperature of another component is directed from a surrounding hood, through the web, and into a perforated roller supporting the web. Alternatively, the through-air bonder may be a flat arrangement wherein the air is directed vertically downward onto the web. The operating conditions of the two configurations are similar, the primary difference being the geometry of the web during bonding. The hot air melts the lower melting polymer component and thereby forms bonds between the filaments to integrate the web.

As used herein, the term "personal care product" means diapers, training pants, absorbent underpants, adult incontinence products, and feminine hygiene products.

Test Methods

Figure 4:
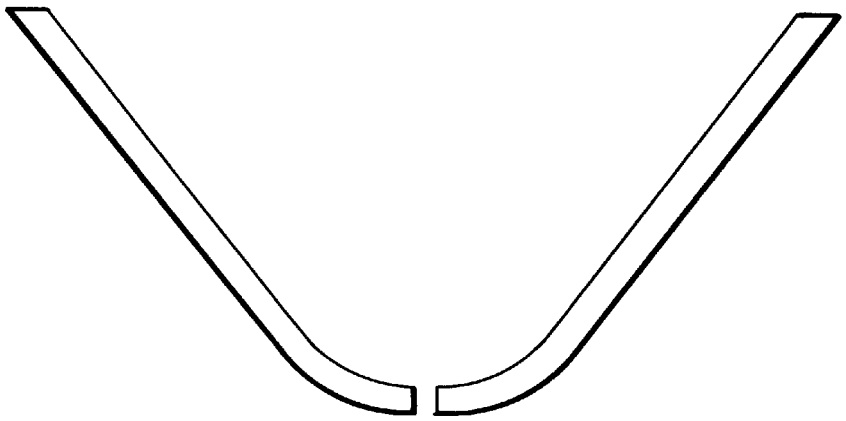
FIG. 4 is a drawing of a side view of a cradle used for the MIST Evaluation test.

Multiple Insult Test (MIST Evaluation): In this test a fabric, material or structure is placed in an acrylic cradle to simulate body curvature of a user such as an infant. Such a cradle is illustrated in FIG. 4. The cradle has a length into the page of the drawing as shown of 33 cm and the ends are blocked off, a height of 19 cm, an inner distance between the upper arms of 30.5 cm and an angle between the upper arms of 60 degrees. The cradle has a 6.5 mm wide slot at the lowest point running the length of the cradle into the page.

The material to be tested is placed on a piece of liquid impermeable film or tape (e.g.: polyethylene film) the same size as the sample and placed in the cradle. The material to be tested is insulted with 80 ml of a saline solution of 8.5 grams of sodium chloride per liter, at a rate of 20 cc/sec with a nozzle normal to the center of the material and ¼–½ inch (6.4 mm–12.7 mm) above the material. The amount of runoff is recorded. The material is immediately removed from the cradle and placed on a dry, tissue covered 40/60 pulp/superabsorbent pad having a density of about 0.2 g/cc in a horizontal position under 0.05 psi pressure and weighed after 5 minutes to determine liquid desorption from the material into the superabsorbent pad as well as liquid retention in the material. The pulp fluff and superabsorbent used in this test is Kimberly-Clark's (Dallas Tex.) CR-2054 pulp and Stockhausen Company's (of Greensboro, N.C. 27406) FAVOR 870 superabsorbent though other comparable pulp and superabsorbents could be used provided they yield a desorption pad of 500 gsm and 0.2 g/cc which after immersion into saline solution under free-swell conditions for 5 minutes, retains at least 20 grams of saline solution per gram of desorption pad after being subjected to an air pressure differential, by vacuum suction for example, of about 0.5 psi (about 3.45 kPa) applied across the thickness of the pad for 5 minutes. This test is repeated using fresh desorption pads on each insult so that a total of three insults are introduced. At least two tests of each sample material are recommended. After testing the following values averaged over the number of specimens tested should be computed:

Weight of fluid in the collection pan after each insult (run-off).

Fluid retained for each insult (i.e., the run-off subtracted from 80 grams)

Fluid retained for each insult divided by the initial weight of the dry specimen.

DETAILED DESCRIPTION OF THE INVENTION

The invention comprises nonwoven fabric made with novel spin packs so that the placement of varying size fibers may be controlled. The fibers so made may be conjugate fibers.

Finer fibers, for example those about 0.5 to 1.5 denier per foot (dpf) are desirable for surge functionality since these yield a fabric having a smaller pore structure resulting in higher capillary tension and improved fluid management. Larger fibers, for example, 2.5 to 5.0 dpf, are also desirable since they enable production of significantly lower density fabrics yielding more void volume at a given basis weight. This type of structure results in rapid fluid intake. A mixed fiber size fabric has the capability of providing the benefits of both large and small fibers in one unified structure.

The inventors have investigated various methods of producing mixed fiber size fabrics. These methods manipulate polymer mass flow rate, throughput or Grams per Hole per Minute (GHM). When subjected to the same process conditions, higher throughput spin holes yield larger fibers as compared to lower throughput spin holes which yield smaller fibers.

The fabric may have discrete zones of pore size or inter-fiber spacing, distribution and permeability accomplished by confining fibers of one size to specified zones and fibers of another size to other zones, hereinafter, embodiment A. This structure allows for fabrics that are substantially uniform in thickness, basis weight and density, yet have zones of relatively high permeability, providing relatively low capillary tension, adjacent to and in liquid communication with zones of relatively low permeability, providing relatively high capillary tension. These fabrics can be designed such that the high permeability portions of the fabric, which provide good liquid intake behavior, can be placed in the product where good intake properties are required, e.g., the insult target area of a personal care product. The liquid will be removed from the intake zones by the adjacent zones of low permeability material that provide the desirable distribution properties.

In another embodiment, the fabric may also have greatly improved uniformity with the larger and smaller size fibers substantially uniformly distributed instead of being confined to a certain area, hereinafter, Embodiment B.

Embodiments which are hybrids of either Embodiment A or B involve mere changes in the placement and arrangement of holes in the spin pack and such fabrics and processes are meant to be within the scope of this invention.

In the spunbond process, fibers are formed by extruding molten thermoplastic material as filaments from a plurality of fine, usually circular capillaries of a spin plate with the diameter of the extruded filaments then being rapidly reduced. The spin pack has a plate set comprising distribution means for distributing and metering the molten polymer, and a spin plate or spinneret having holes through which the polymer is extruded and fiberized. Further, there may be multiple sets of spin packs producing multiple layers of fabric, depending on the complexity of the product desired.

Figure 3:
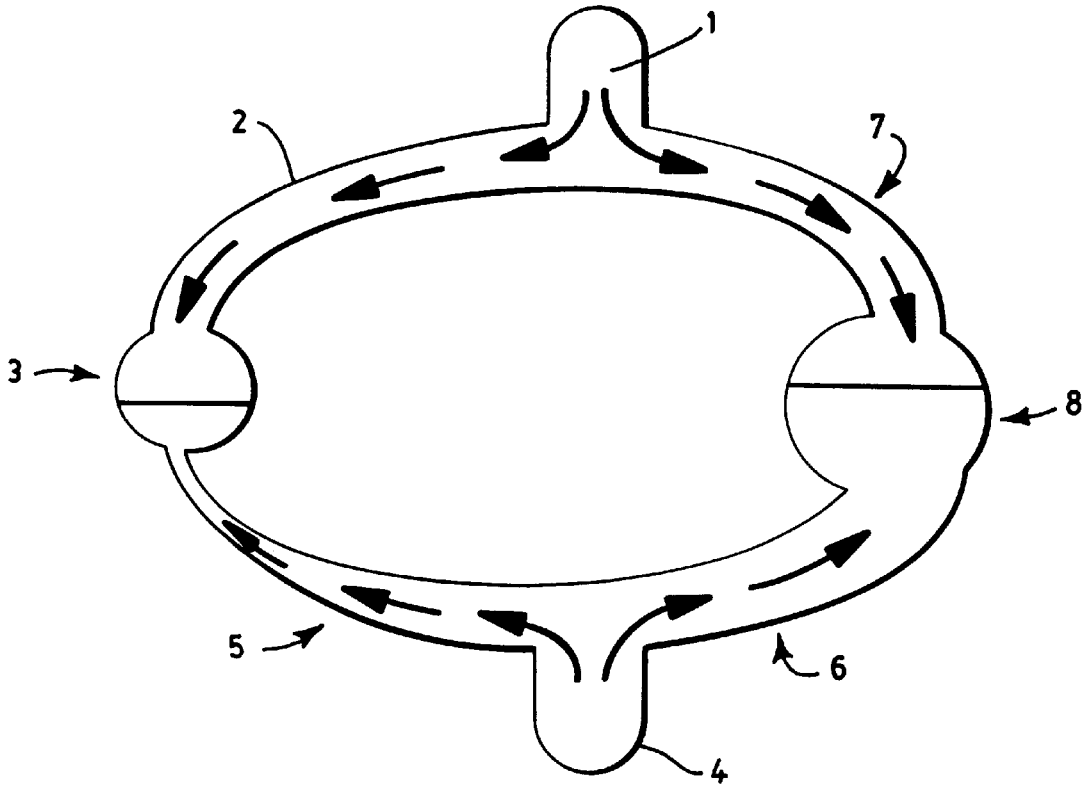
FIG. 3 is a diagram of the flow paths used in the spin pack's polymer distribution plates in order to produce a 40:60 polymer ratio for high rate fibers and 60:40 for low rate fibers.

In spunbonding, the thermoplastic polymer is melted and routed through distribution channels which direct and ration polymer to each capillary or hole in the spin plate. Such rationing is accomplished through the design of the distribution channels in the distribution or metering plate. Distribution means for conjugate fibers are more complex than those for single component fibers, since, of course, more than one polymer must be distributed. One example of conjugate fiber distribution channel sizing may be seen in FIG. 3 which shows a view of polymer distribution in the X-Y plane of a distribution or metering plate. Polymer enters the view illustrated in FIG. 3 from above at points 1 and 4, flows through channels 2, 5, 6, 7 and exits at holes 3, 8 to supply spin holes below and form fibers. In FIG. 3, a first polymer, beginning at a first point 1, is routed through a larger channel 2 to supply the smaller fiber hole 3 and a second polymer, beginning at a second point 4, is routed through a smaller channel 5 than that of the first polymer to produce a fiber which contains a majority of the first polymer. The roles are reversed for the larger fiber hole 8 so that the second polymer is the majority polymer and the reason for such a reversal will be discussed below. In FIG. 3 the fibers produced are in a polymer ratio of 60:40 and 40:60 though by appropriate channel sizing, virtually any ratio may be produced.

The distribution means supplies polymer to the holes in the spin plate. FIG. 1 shows a spin plate 9 having holes of varying size to extrude varying volumes of polymer through the holes. The standard spin plate has holes of uniform size which are round though the fiber shape is limited by imagination only and may be multilobal, star shaped or shaped like the letters C, E, X, T etc.

FIG. 1 shows a spin plate 9 having bolt holes 10 for attachment to other parts of the spin pack apparatus. The spin plate 9 has small holes 11 and large holes 12 separated into groups by size and producing finer fibers 13 and larger fibers 14. The fibers are arranged so that the fibers of different sizes remain separate as produced in the machine direction 15 indicated by an arrow.

Figure 2:
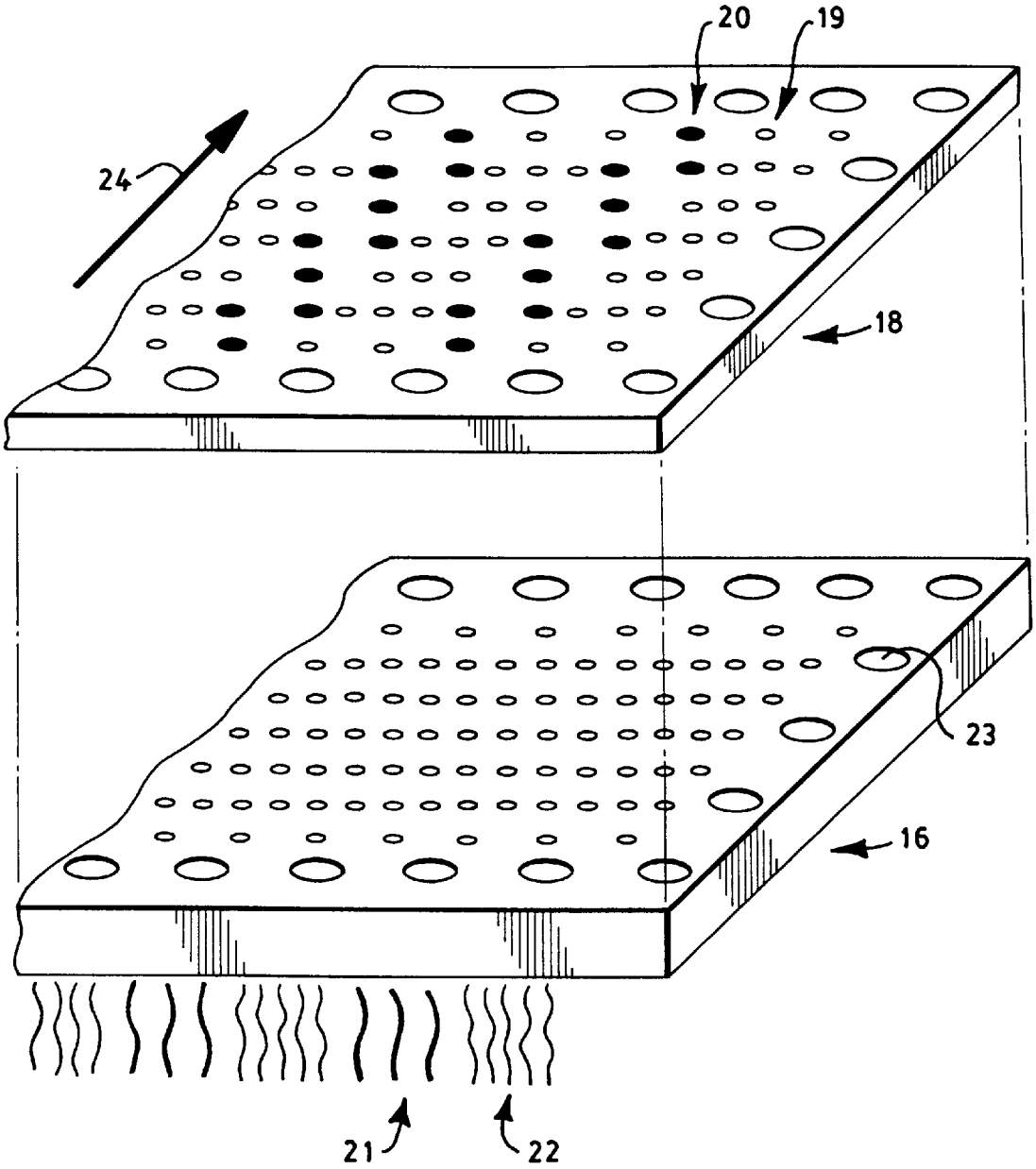
FIG. 2 is a diagram of a standard spinplate or spinneret in which all of the fiber producing holes are of the same dimensions with a metering plate above in which some holes are larger than others.

FIG. 2 shows a standard spin plate 16 having uniformly sized holes 17 located adjacent a distribution or metering plate 18 having non-uniformly (small 19 and large 20) sized holes. This alternative arrangement may also be used in order to produce the fabric of this invention since varying the volume of polymer to particular holes of a standard spin plate results in larger 21 or smaller 22 size fibers. The large bolt holes 23 are also shown and an arrow indicates the machine direction 24. Dashed lines with arrows indicate the alignment of the spin plate 16 and distribution plate 18.

The fiber size distribution desired for Embodiment A is obtained by design of the fiber producing spin pack such that the molten polymer is delivered at a higher rate to the holes in the spin plate in regions where larger fibers are desired as outlined above. This can be accomplished in several ways:

1. The preferred way is through design of the spin pack's distribution plate leading to high polymer throughput per hole in regions where large fibers are desired and low polymer throughput per hole in regions where smaller fibers are desired. A standard spin plate in which all of the fiber producing holes are of the same dimensions is used with this approach (FIG. 2). This approach allows more flexibility and requires lower cost, shorter lead time for hardware since a thin distribution or metering plate can be produced relatively easily and quickly as compared to a specialized spin plate.
2. An alternate method is through design of the spin plate itself whereby the holes through which high polymer throughputs are desired are larger than the holes where the lower throughputs are desired (FIG. 1). This approach is more expensive to produce since the fiber forming portion of the spin plate is highly machined to produce very smooth wall capillaries to reduce fiber breakage.

In both of these approaches, active spin hole density may be controlled to achieve a uniform basis weight profile. However, when desired, active spin hole density can be manipulated to obtain zoned basis weight in combination with zoned fiber size.

In order to produce the fabric of Embodiment B, the hole placement may be altered such that the larger and smaller fibers are interspersed. Alternatively, the hole placement may be maintained as in Embodiment A, but the machine direction changed to an orientation perpendicular to that shown in FIGS. 1 and 2. Most preferably, to produce the mixed fiber size fabric of Embodiment B, the high and low throughput spin holes are arranged so that an uniform mix of large and small size fibers are formed in the cross direction of the spunbond process, as shown in FIG. 6.

Figure 5:
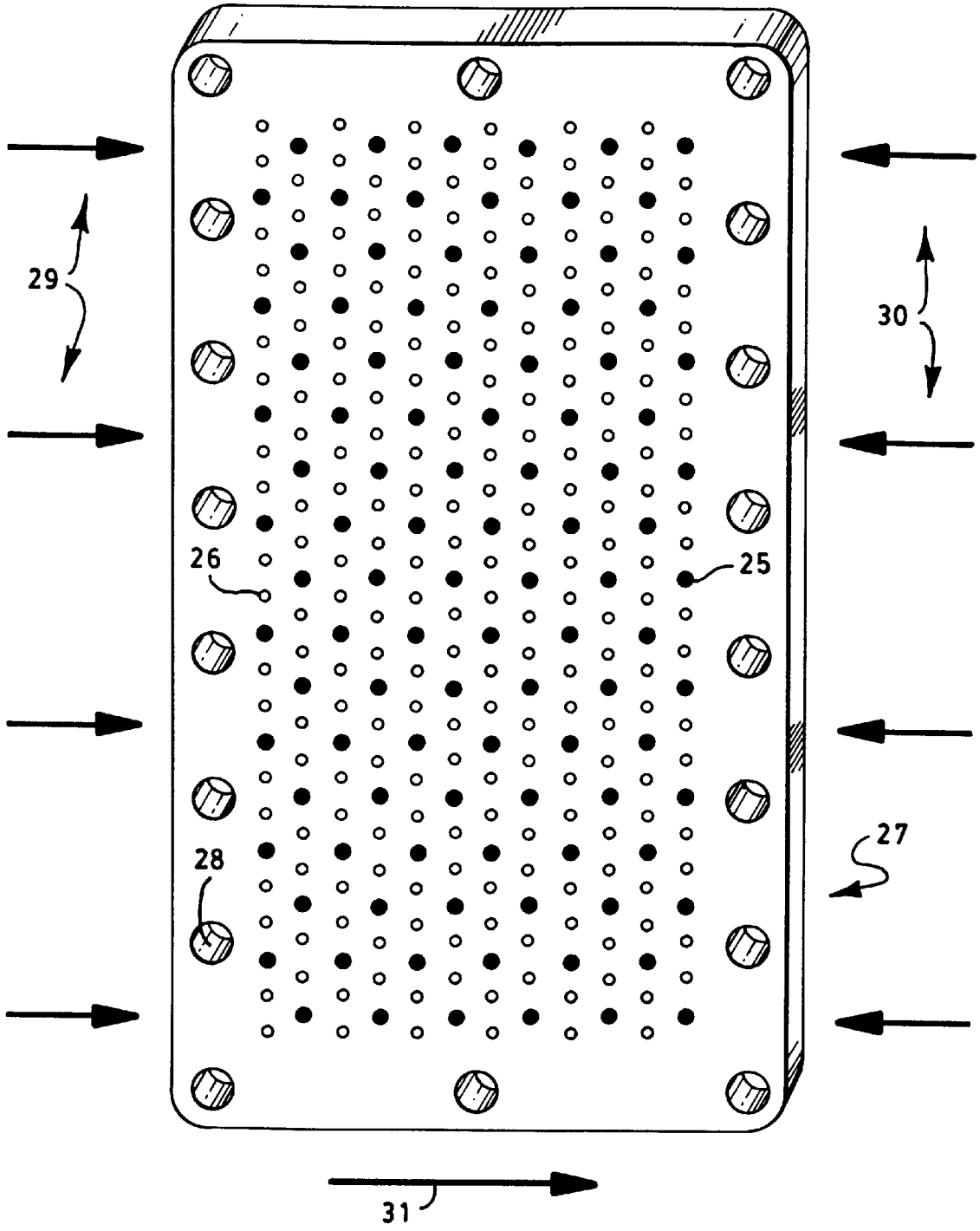
FIG. 5 is a drawing of a spin plate having high and low flow rate holes interspersed.

FIG. 5 shows the high throughput spin holes 25 and low throughput spin holes 26 interspersed substantially uniformly across the active area of the spin plate which also includes bolt holes 28. Quench air 29, 30 on either side is provided as shown and the machine direction 31 is also indicated. The inventors have found that this approach yields poor spinning and formation of fabrics due to quenching problems. The high throughput spin holes have a significantly higher quench requirement as compared to the low throughput spin holes. The smaller size fibers produced by the low throughput spin holes are more delicate and break when subjected to the quench air flows required by the larger fibers. These quenching difficulties are not encountered during the zoned fiber size fabric production since the hole density of the high throughput spinning areas was reduced to maintain a constant basis weight in the cross direction as shown in FIGS. 1 and 2, making the quench requirement for both the large and small size fiber zones similar.

Figure 6:
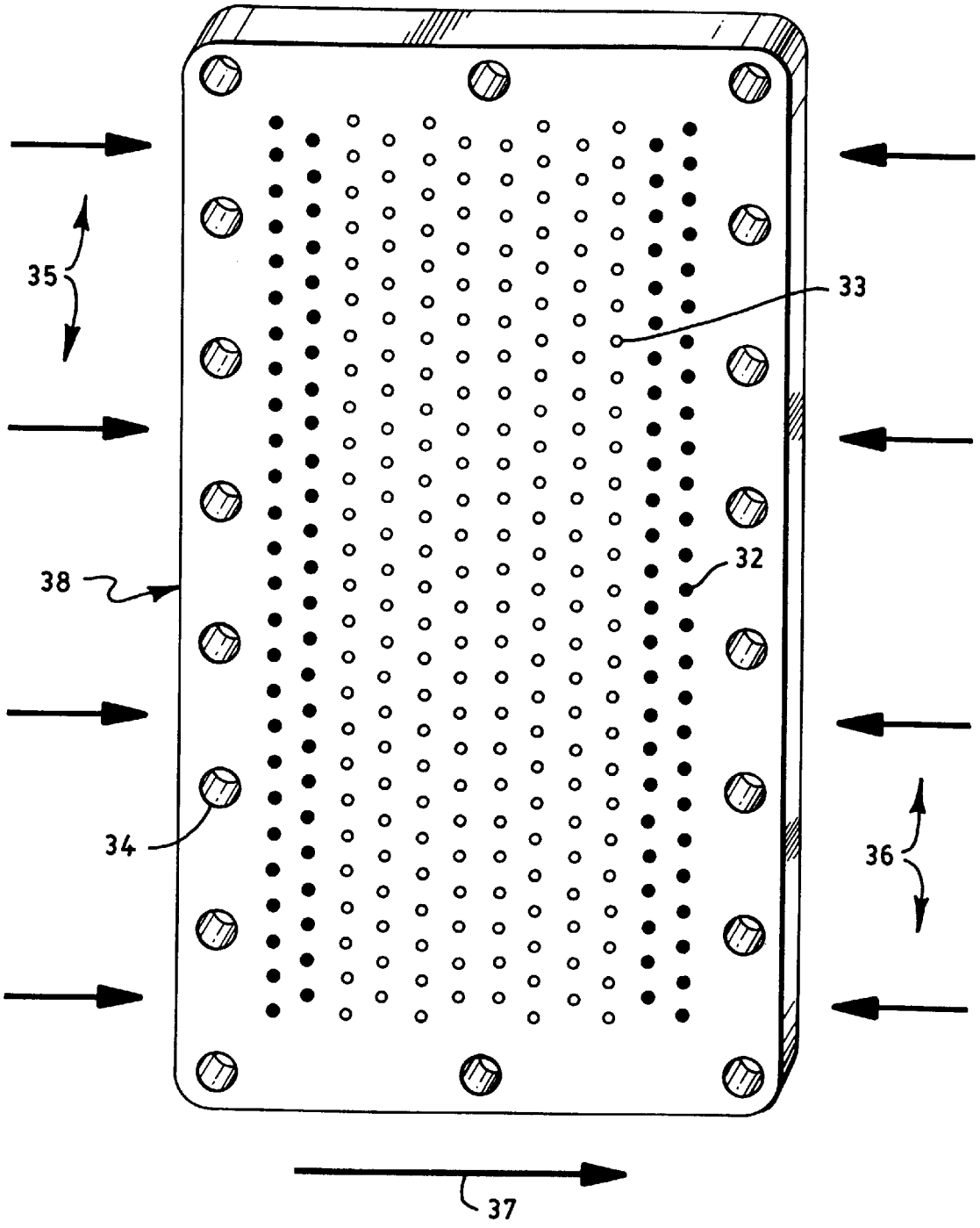
FIG. 6 is a drawing of a spin plate having high and low flow rate holes segregated so that the high flow rate holes are on the perimeter of the fiber bundle and the low flow rate holes are on the inside or central part of the fiber bundle.

Another method for producing mixed fiber size spunbond is depicted in FIG. 6. In FIG. 6, the high throughput spin holes 32 were located nearest the quench supplies 35, 36 and the low throughput spin holes 33 were located in the center of the spin plate's 38 active area. FIG. 6 also shows bolt holes 34 and the machine direction 37. This approach yields excellent spinning and produces very good formation fabrics. In this approach the larger size fibers are contacted by the quench air first and act as a curtain to slow the air flow before it reaches the more delicate smaller fibers near the center of the fiber bundle. These larger and smaller fibers become substantially completely inter-mixed once they pass through the long narrow slot of a fiber drawing apparatus (not shown).

In order to produce fabrics having high void volume and permeability, the fibers used in the practice of this invention should be crimped according to the teachings of U.S. Pat. No. 5,382,400 to Pike et al. in which crimp is induced in the conjugate fibers by using the differential rates of expansion and contraction of the two (or more) polymers. After the fibers leave the spin pack, i.e., during fiber formation, and before deposition on a foraminous belt where the nonwoven web is formed, the fibers are attenuated and subjected to a temperature which will cause them to curl and crimp, similar to the action of a bimetallic strip in a common home thermostat. This temperature level is commonly delivered by air which is blown across the fibers for cooling and will vary depending on the polymers used in the fibers. Crimping may be further enhanced by the use of hot air in the unit that attenuates the fibers as taught in U.S. Pat. No. 5,382,400.

While the fibers produced according to this invention may be bonded by any workable method known in the art, particularly with conjugate fiber webs, Through-air bonding is preferred.

One of the difficulties commonly encountered when spinning a bundle of conjugate fibers in which some of the fibers are significantly larger than the others, is in achieving optimal fiber helical crimp levels in both fiber sizes at the same time under the same process conditions. Under conditions providing optimal crimp for larger fibers, smaller fibers tend to have low helical crimp and lay flat, yielding high density webs. Similarly, under conditions providing optimal crimp for smaller fibers, larger fibers tend to have very high helical crimp levels that form small balls yielding poor formation. This problem can be overcome by varying the polymer ratios used in each fiber size to achieve similar fiber crimp levels.

The polymer ratios, as stated previously, may be varied from virtually 100 to 0 percent of either polymer. Its been found that good crimping levels may be achieved at ratios of from about 75:25 to about 25:75. More preferable ratios are between about 70:30 and 30:70, and still more preferable ratios between about 60:40 and 40:60. Most preferably, in a side-by-side conjugate fiber, its been empirically found that the smaller fibers should have about a 60:40 polymer ratio, where the greater (60%) component is the shrinking component, while the larger fibers should have about a 40:60 polymer ratio, where the lesser (40%) component is the shrinking component. This type of polymer distribution can be obtained through appropriate sizing of the flow channels or paths used in the spin pack's polymer distribution plates (FIG. 3). Those skilled in the art will be capable of designing appropriately sized distribution channels without undue experimentation using conventional fluid dynamics based on the viscosity and other properties of the specific polymers used as well as the fiber sizes and ratios desired.

The end result of the approach using either case 1 or 2 and the appropriately sized distribution channels is a mixed fiber size fiber bundle. This may be used for the production of zoned permeability fabric (Embodiment A) or highly uniform fabric (Embodiment B), as well as other fabrics between these two apparent extremes. It is also possible to produce, in addition to homopolymer fibers, conjugate fibers with a mixed polymer ratio using this approach. Combining the two allows for directly forming fibers using mixed polymer ratios and mixed polymer metering combined to produce very functional nonwoven fabrics.

The fibers of which the fabric of this invention may be made are thermoplastic polymers which may be processed in the spunbond process. Such polymers include polyolefins, for example polyethylenes such as Dow Chemical's ASPUN(® 6811A linear low density polyethylene, 2553 LLDPE and 25355 and 12350 high density polyethylene are such suitable polymers. The polyethylenes have melt flow rates, respectively, of about 26, 40, 25 and 12. Fiber forming polypropylenes include Exxon Chemical Company's Escorene® PD 3445 polypropylene and Montell Chemical Co.'s PF-304. Many other polyolefins are commercially available.

EXAMPLES 1 THROUGH 5

The following materials were composed of through-air bonded conjugate spunbond fabric in which the first polymer was least 98% linear low density polyethylene (Dow Chemical Co.'s 61800) and the second polymer was at least 98% polypropylene (Exxon Chemical Co.'s Escorene® PD-3445). The remainder of each polymer included pigments and additives to enhance fiber crimping. All testing was done on two layers of the specified material.

In the examples below, Example 3 has zones of differing permeability and is a representative of the invention wherein one zone's permeability is 2 times the permeability of another zone. This material was made generally in accordance with the teachings of U.S. Pat. No. 5,382,400 except that the spin pack setup was as shown in FIG. 2 to provide the desired zoning of fiber sizes at a uniform basis weight. The fibers contained about 50 weight percent of each of the two polymers in a side-by-side configuration. The inventors have found that the higher permeability zone should have a permeability of at least 1.5 times the permeability of the lower permeability zones in order to function well in the desired personal care applications for embodiment A. In the modified MIST test, the high permeability zone of Example 3 is in the center of the fabric and in the region to which the fluid insults are applied. The low permeability regions are adjacent to the high permeability zone and at the ends of the sample. These ends are vertically elevated above the center zone when the specimen is placed in the test cradle.

Table 1 gives the process conditions for key process variables.

TABLE 1

| Process Parameter | Example 1 | Example 2 | Example 3 |
|---|---|---|---|
| Quench air temp. (° F.) | 65 | 65 | 67 |
| Crimp Index Scale 1-to-5 1 = No Crimp, 5 = High Crimp (approx. 30 per inch) | 3 | 4 | 4 |
| Extrusion temp. for both A & B polymers (° F.) | 450 | 450 | 450 |
| Throughput (grams/hole/min.) | 0.6 | 0.35 | 0.55/0.35 (avg = 0.45) |
| Spin pack (holes per inch) | 48 | 48 | 44 |
| Spin hole diameter (mm) | 0.4 | 0.4 | 0.4 |
| Draw air pressure (psig) | 3.0 | 6.0 | 6.0 |
| Draw air temp. (° F.) | 345 | 340 | 350 |
| TAB Temp (° F.) | 254 | 253 | 260 |

TABLE 1-continued

| Process Parameter | Example 4 | Example 5 |
|---|---|---|
| Quench air temp. (° F.) | 61 | 62 |
| Crimp Index Scale 1-to-5 1 = No Crimp, 5 = High Crimp (approx. 30 per inch) | 3 | 4 |
| Extrusion temp. for both A & B polymers (° F.) | 450 | 450 |
| Throughput (grams/hole/min.) | 0.8/0.3 (avg = 0.5) | 0.75/0.38 (avg = 0.5) |
| Spin pack (holes per inch) | 40 | 48 |
| Spin hole diameter (mm) | 0.4 | 0.4 |
| Draw air pressure (psig) | 8.0 | 8.0 |
| Draw air temp. (° F.) | 347 | 342 |
| TAB Temp (° F.) | 265 | 265 |

Examples 1 and 2 are uniform in permeability and not representative of Embodiment A. The permeability of Example 1 is higher than, but similar to that of the center region of Example 3. The permeability of Example 2 is similar to but lower than that of the ends of Example 3. Examples 1–3 were treated with a solution of 3 parts Ahcovel Base N62 (available from Hodgson Textile Chemicals, Mount Holly, N.C.) and 1.7 parts Glucopon 220 UP (available from Henkel Corporation, Ambler, Pa.). The fabric was saturated with the solution and the excess fluid vacuum extracted. The fabrics were then oven dried at 100° C. The final treatment levels on the fabric in terms of active solids was 2.25% Ahcovel Base N62, 0.75% Glucopon 220 UP. The basis weight, thickness, and density measurements shown in Table 2 were made on the treated fabrics. All MIST testing was done with treated fabrics.

Example 4 is uniform in permeability and comprises a uniform mixture of 33 weight percent, 0.9 denier and 67 weight percent, 2.8 denier fibers, all of which are 50 weight percent polyethylene (PE) and 50 weight percent polypropylene (PP). Example 5 is uniform in permeability, comprising a uniform mixture of 50 weight percent, 1.2 denier fibers that are approximately 50 weight percent PE and 50 weight percent PP, and 50 weight percent 2.4 denier fibers that are approximately 70 weight percent PP and 30 weight percent PE.

Table 2 shows the properties of some Example fabrics.

TABLE 2

| Ex. Number | Basis Wght (osy) | Fabric Thcknss (mil) | Fabric Dnsty (g/cc) | Fiber Size (denier) | Riese Perm. ($\mu^2$) | MIST Test Fluid Held (g/fluid per g fabric) |
|---|---|---|---|---|---|---|
| 1 | 2.43 | 136 | .024 | 3.1 | 2000 | 18.4 |
| 2 | 2.92 | 109 | .036 | 1.1 | 375 | 14.8 |
| 3 | 2.74 | 167 | .022 | See note (1) | See note (2) | 20.0 |

Notes:
(1) The material of Example 3 consisted of a 2.5 inch (64 mm) long center zone of 2.2 denier fibers with 2.25 inch (57 mm) end zones of 1.1 denier fibers (providing the total sample length of 7 inches (178 mm).
(2) The Riese permeability in the center zone of Example 3 is 1630 $\mu^2$. The permeability of the end zones is 815 $\mu^2$.
(3) Fabric thickness was measured under a 3 inch (76 mm) diameter circle of plastic applying a load of 0.05 psi.

TABLE 2-continued

| Ex. Number | Basis Wght (osy) | Fabric Thcknss (mil) | Fabric Dnsty (g/cc) | Fiber Size (denier) | Riese Perm. ($\mu^2$) | MIST Test Fluid Held (g/fluid per g fabric) |
|---|---|---|---|---|---|---|

(4) Riese permeability in square microns ($K_{Riese}$) is determined by the following formula:

$K_{Riese} = 0.075R^2(1 - X)(X/(1 - X))^{2.5}$

Where:

R = the average fiber radius in microns

X = the porosity of the fabric = $(d_{fiber} - d_{fabric})/d_{fiber}$ $d_{fiber}$ = the density of the fibers in g/cc. (This is 0.91 g/cc for all of the above fabrics.)

$d_{fabric}$ = the density of the fabric in g/cc based on a fabric thickness measured under a load of 0.05 psi.

Retained fluid performance is determined by placing a saturated sample in the test cradle and measuring the amount of fluid the sample retains after draining. The amount of fluid retained per gram of material is another measure of the sample's ability to hold onto or manage fluid in an absorbent product. Retained fluid data is given in Table 3.

TABLE 3

| Example Number | Fiber Size (denier) | Riese Permeability ($\mu^2$) | MIST Test Fluid Retained (g fluid per g fabric) |
|---|---|---|---|
| 1 | 3.1 | 2000 | 30.4 |
| 2 | 1.1 | 375 | 24.8 |
| 3 | Zoned 1.1/2.2 denier | Zoned 1630/815 | 37.1 |

The above examples show that the material representing Embodiment A (Example 3) provides performance in the MIST test that is superior to the comparatives.

Table 4 shows additional properties of selected Example fabrics. The values shown here are based on measurements of untreated fabrics since not all of the fabrics were treated and MIST tested.

TABLE 4

| | Example 1 | Example 4 | Example 5 |
|---|---|---|---|
| Basis Weight (osy) | 2.5 | 2.5 | 2.5 |
| Fiber Linear Density (denier) | 3.0 | 0.9/2.8 | 1.2/2.4 |
| Fabric Thickness (mil) | 160 | 155 | 165 |
| Density (g/cc) | 0.021 | .022 | .020 |
| Void Volume (cc void/g fabric) | 46.2 | 45.2 | 48.2 |
| Maximum Vertical Wicking Height (cm) | 1.2 | 1.6 | 1.6 |

Note: The Maximum Vertical Wicking Height (MVWH) is calculated based on the assumption of uniform fiber spacing with the given fiber sizes and web density, using a fluid having a surface tension of 54 dynes/cm and a density of 1 g/cc with a contact angle with the fibers of 60°.

The results in Table 4 show that the Example 4 (mixed fiber size, uniform polymer ratio) is comparable to Example 1 (uniform fiber size and polymer ratio) with respect to void volume, but superior to it with respect to MVWH and thus would provide improved fluid handling performance when used as a surge material in an absorbent product. The improvement results from the combination of the large fibers (which provide the low density/high void volume) with the small fibers (which provide the reduced interfiber spacing and thus improved wicking).

The results in Table 4 further show that Example 5 (mixed fiber size, mixed polymer ratio) provides a fabric that is lower in density and higher in void volume than Examples 1 and 4, yet comparable in MVWH to Example 4. This is accomplished in Example 5 with less of the fiber mass used in large fibers—which are the major contributors to low density/high void volume—than in Example 4. The improvement is due to the improved distribution of the polymer resulting in small fibers having about the same amount of crimp as the large fibers.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means plus function claims are intended to cover the structures described herein as performing the recited function and not only structural equivalents but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A nonwoven fabric comprising direct formed fibers of mixed sizes larger than 7 microns and having a substantially uniform distribution of said mixed size fibers.

2. A nonwoven fabric comprising direct formed fibers of mixed sizes larger than 7 microns having a non-uniform distribution of said mixed size fibers such that said fabric has a high permeability zone and a low permeability zone in which the high permeability zone has a permeability of at least 1.5 times that of the low permeability zone.

3. The fabric of claim 2 in which the high permeability zone has a permeability of at least 2 times that of the low permeability zone.

4. The fabric of claim 2 wherein said fibers are conjugate fibers.

5. The fabric of claim 4 wherein said conjugate fibers are made from two thermoplastic polymers.

6. The fabric of claim 5 wherein said polymers are polyolefins.

7. The fabric of claim 6 wherein said polyolefins are polypropylene and polyethylene.

8. The fabric of claim 4 wherein said conjugate fibers have polymers arranged in a side-by-side configuration.

9. The fabric of claim 4 wherein said conjugate fibers comprise two polymers in a ratio of 60:40 for smaller size fibers and 40:60 for larger fibers.

10. The fabric of claim 1 wherein said fibers are conjugate fibers.

11. The fabric of claim 10 wherein said conjugate fibers are made from two thermoplastic polymers.

12. The fabric of claim 11 wherein said polymers are polyolefins.

13. The fabric of claim 12 wherein said polyolefins are polypropylene and polyethylene.

14. The fabric of claim 11 wherein said conjugate fibers have said polymers arranged in a side-by-side configuration.

15. The fabric of claim 10 wherein said conjugate fibers comprise two polymers in a ratio of 60:40 for smaller fibers and 40:60 for larger fibers.

16. The fabric of claim 1 wherein said mixed size fibers have substantially equal crimp.

17. The fabric of claim 1 wherein said nonwoven fabric is made by the spunbond process.

18. The fabric of claim 1 which is substantially uniform in basis weight and density.

19. The fabric of claim 1 wherein said fibers have a shape selected from the group consisting of star, C, E, X, T and multilobal shapes.

20. A personal care product comprising the fabric of claim 1.

21. A personal care product comprising the fabric of claim 2.

* * * * *